US005185954A

United States Patent [19]

Waddle, Sr.

[11] Patent Number: 5,185,954

[45] Date of Patent: Feb. 16, 1993

[54] PET PORTAL DEVICE

[76] Inventor: Richard L. Waddle, Sr., 14401 Black Horse Ct., Centerville, Va. 22020

[21] Appl. No.: 898,819

[22] Filed: Jun. 15, 1992

[51] Int. Cl.[5] ..... E06B 7/28

[52] U.S. Cl. ..... 49/168; 49/169; 49/178

[58] Field of Search ..... 49/169, 168, 163, 177, 49/178; 160/102, 40, 205, 180

[56] References Cited

U.S. PATENT DOCUMENTS

| | | | |
|---|---|---|---|
| 3,464,158 | 9/1969 | Greene | 49/168 |
| 3,654,733 | 4/1972 | Blackwell | 49/168 |
| 3,811,224 | 5/1974 | Garrison | 49/168 |
| 3,878,645 | 4/1975 | Porter | 49/169 |
| 4,322,913 | 4/1982 | Himmer | 49/169 X |
| 5,105,868 | 4/1992 | Riise | 49/168 X |

*Primary Examiner*—Philip C. Kannan

*Attorney, Agent, or Firm*—Frank P. Presta

[57] ABSTRACT

A pet portal device for use with a sliding door or the like mounted in a frame and which is movable therein to define an opening between the closure end of the door and the frame. The device includes a panel member constructed to fit in the opening between the closure end of the door and the adjacent frame portion to close the opening. The panel member is provided with an assembly for enabling a pet to pass through the panel member. The panel member is movably connected to the door, such that theh panel member is selectively movable between a first position wherein it is in substantially coplanar relation with the door to close the opening and a second position wherein the panel member is supported out of coplanar relation with the door to enable the door to be closed in a conventional manner.

9 Claims, 2 Drawing Sheets

PET PORTAL DEVICE

BACKGROUND OF THE INVENTION

The present invention relates to a pet portal device and, more particularly, to a new and improved pet portal device which is particularly constructed to enable the device to be pivotally connected with an existing sliding glass door for selectively enabling a pet to enter and exit therethrough.

It is often desirable to enable a pet to enter and exit a dwelling at will and without human assistance, particularly when a pet remains alone at the dwelling for extended periods of time. Many homes are provided with a sliding glass door or the like which provides access to a porch, balcony, yard or similar area in which a pet may be permitted to roam. When it is desired to provide a pet access through the sliding glass door, it has been necessary to leave the door slightly ajar which leaves the home unsecured and subject to weather conditions. Clearly, it is not feasible to cut an opening in the sliding glass door since glass is not easy to work with and it would permanently damage the door.

Therefore, a need has been created for an economical pet portal device which can easily be used with an existing sliding glass door to enable a pet to enter and exit therethrough. The pet portal device of the present invention meets this need.

BRIEF DESCRIPTION OF THE RELATED ART

Various pet portal devices constructed for use with a sliding door are known in the art as evidenced by the U.S. Pat. No. 3,464,158 to Greene, Blackwell U.S. Pat. No. 3,654,733, Garrison U.S. Pat. No. 3,811,224, and Porter U.S. Pat. No. 3,878,645.

All of these known pet portal devices provide a panel which is constructed to fit in the frame of a partially open sliding door, wherein an opening with a movable closure is provided in the panel for enabling a pet to enter and exit therethrough. While such known devices work satisfactorily while positioned in the door frame, they require the device to be completely removed from the door and stored somewhere when it is desired to use the sliding door in a conventional manner without the device. The known devices can not quickly and easily be moved in and out of a position in the sliding door frame. Also, when such known devices are positioned in the door frame, in many instances there is insufficient space between the fully open sliding door and the pet portal device to allow human ingress and egress therethrough.

The new and improved pet portal device of the present invention was developed to overcome the disadvantages of known devices hereinbefore described by providing a pet portal device which is constructed to enable the device to be pivotally connected with the sliding glass door such that the device can be quickly, easily and conveniently pivoted in and out of coplanar relation with the sliding door to enable a pet to pass therethrough and to allow the door to be used in the conventional manner.

SUMMARY OF THE INVENTION

Accordingly, it is a primary object of the present invention to provide a new and improved pet portal device for use with an existing sliding glass door or the like which is constructed to enable the device to be movably connected therewith.

Another object of the invention is to provide a pet portal device for use with a sliding door which does not require the device to be disconnected from the door when it is desired to use the door in a conventional manner without the device.

A more particular object of the present invention is to provide a pet portal device including a panel member constructed to fit in a sliding door frame opening, means for enabling a pet to pass through the panel member, and means for pivotally connecting the panel member to the sliding door, whereby the panel member is selectively pivotable between a first position wherein the panel member is in substantially coplanar relation with the door and closes the opening and a second position wherein the panel member is supported out of coplanar relation with the door thereby enabling the door to be closed in a conventional manner.

DESCRIPTION OF THE DRAWINGS

Other objects and advantages of the subject invention will become apparent from a study of the following specification when viewed in light of the accompanying drawing, in which.

DETAILED DESCRIPTION

Figure 1:
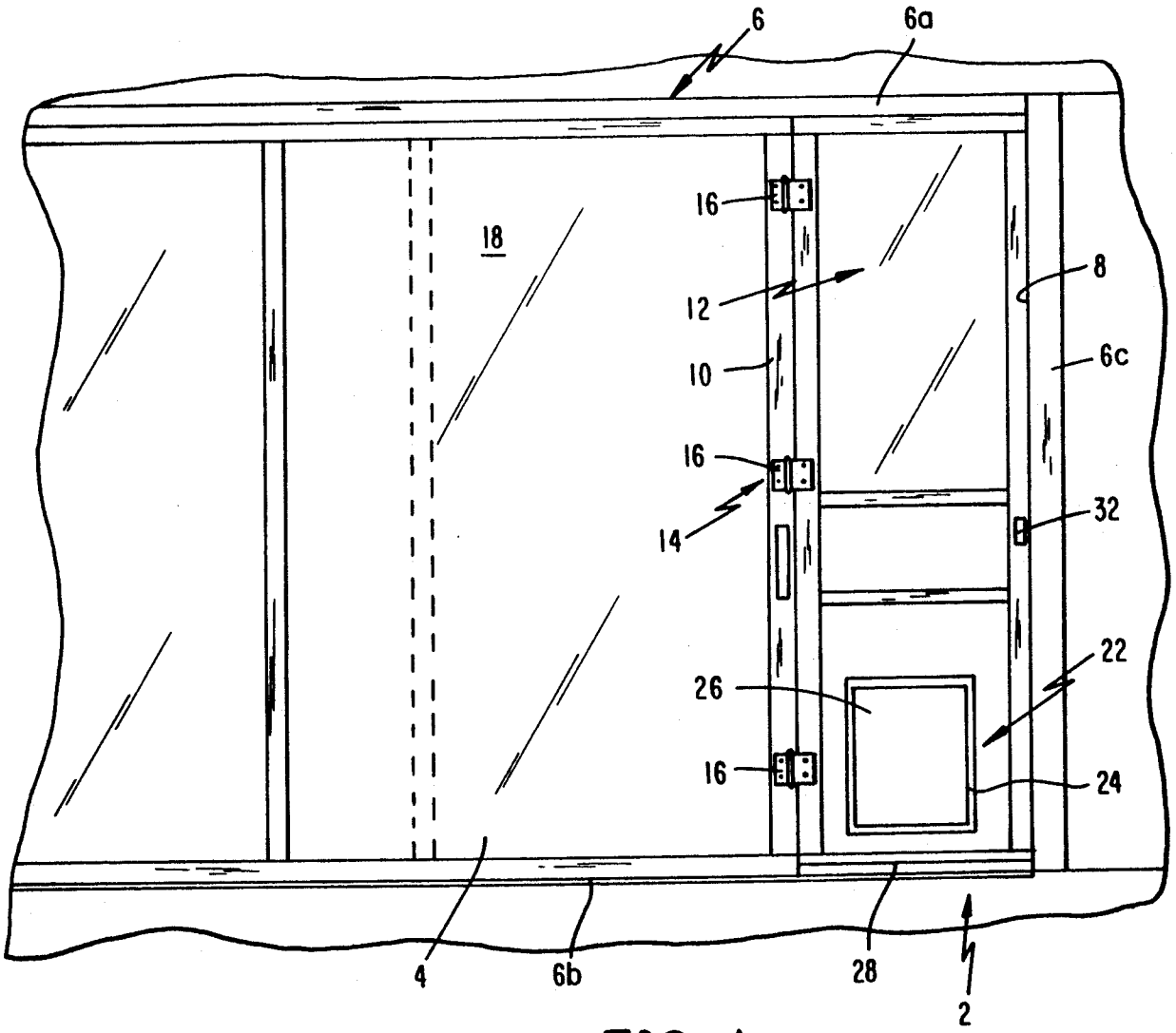
FIG. 1 is a front elevational view the pet portal device of the present invention in use with a conventional sliding door.

Referring now to FIGS. 1 through 4, in which like reference numerals designate similar parts throughout the various views, there is shown the pet portal device 2 of the present invention in use with a conventional sliding glass door 4 mounted in a frame 6 including upper, lower and side frame portions 6*a*, 6*b* and 6*c*, respectively, and which is movable therein to define an opening 8 between the closure end 10 of the door 4 and the frame 6.

The pet portal device 2 includes a panel member 12 which is constructed to fit in the door opening 8 between the closure end 10 of the door 4 and one side portion 6*c* of the frame 6. The panel member 12 may be made of wood, plastic, metal, glass or any other suitable material or combination thereof. The height of the panel member 12 is substantially equal to the height of the door 4 and the width is preferably approximately sixteen and one-half inches, but any other suitable width which can fit in an open sliding door 4 may be used. Means 14 is provided for movably connecting the panel member 12 with the door 4. Preferably, connecting means 14 includes a plurality of hinge members 16 having one side connected to the inner closure end portion 10 of the door 4 and the other side connected to the adjacent inner portion of the panel member 12, as shown in FIG. 1. However, any other suitable means for pivotally connecting the panel member to the door may be used. Preferably, the hinge members 16 are secured to the door 4 adjacent the closure end 10, which normally includes a metal frame member, with the use of screws or the like. Under normal conditions, two or three spaced hinge members 16 will be sufficient for connecting the panel member 12 to the door 4 and, therefore, will only require approximately four to six screw holes to be made in the closure end 10 of the door 4, which can easily be repaired and will not permanently deface the door if the pet portal device 2 is no longer going to be used therewith. Alternatively, hinge members 16 could be secured to the door with an adhesive, suction cups or other suitable means secured on the closure end 10 or on the glass portion 18 of the door 4.

Figure 2:
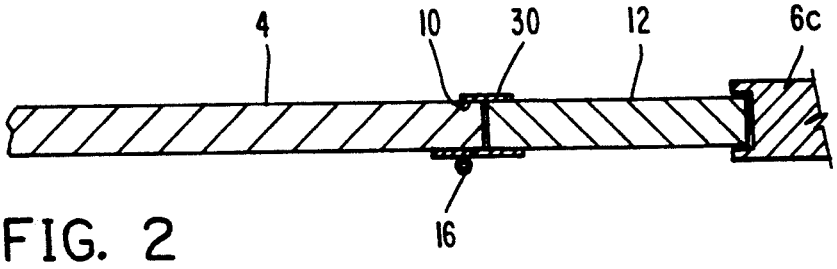
FIG. 2 is a top plan view in section of the device of FIG. 1.
Figure 3:
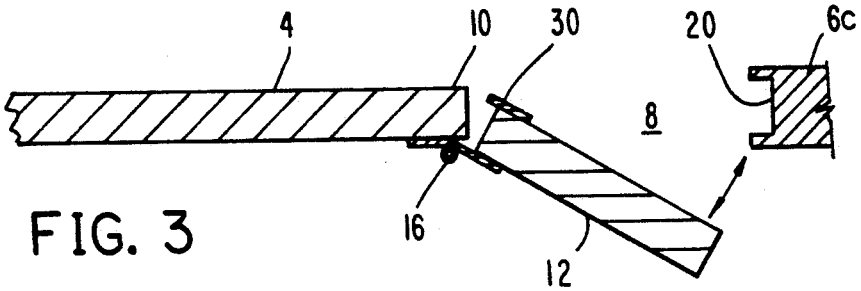
FIG. 3 is a top plan view like that of FIG. 2, wherein the panel member is partially pivoted out of the door frame opening.
Figure 4:
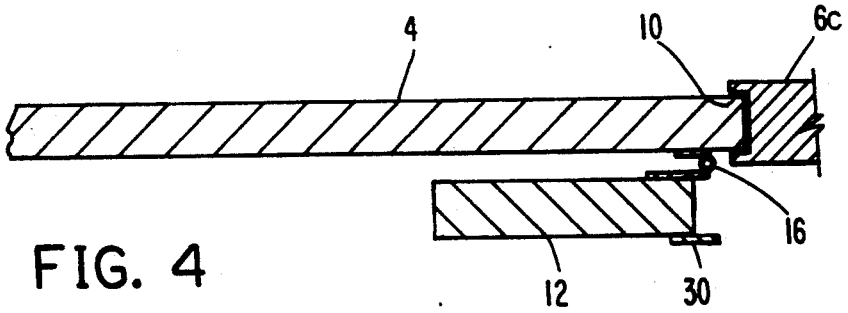
FIG. 4 is a top plan view like those of FIGS. 2 and 3, wherein the panel member is pivoted completely out of the door frame opening and the sliding door is closed in a conventional manner.

In accordance with the invention, the pivotal connecting means 14 enables the panel member 12 to be selectively pivotable between a first position, as shown in FIGS. 1 and 2, wherein the panel member 12 is in substantially coplanar relation with the door 4 and closes the door opening 8, and a second position, as shown in FIG. 4, wherein the panel member 12 is supported out of coplanar and in substantially parallel relation with the door 4 such that the door 4 can close in a conventional manner. Preferably, the hinge members 16 are positioned on the inside of the door 4 so that the panel member 12 pivots toward the inside of the house. Preferably, the hinge members 14 enable the panel member 12 to pivot inwardly to a substantially parallel position with the door 4 so as not to obstruct the interior space of the house when in the second position.

Regardless of the type of pivotal connecting means 14 which is used, an important feature of the invention is the ability of the door 14 to close normally and completely when the panel member is in the second position. Therefore, the pivotal connecting means 14 is preferably connected with the door 4 at a point which is set back from the closure end 10 a sufficient distance so as not to interfere with the closing of the door 4 in the frame 6. Most sliding door frames 6 have a side frame portion **6*c* which includes a recess 20 along the length thereof for receiving the closure end 10 of the door 4 therein. Therefore, the pivotal connecting means 14 is preferably connected to the door 4 at a point which is set back from the closure end 10 a sufficient distance to enable the closure end 10 to be received in the recess 20 in the conventional manner when the panel member is in the second position as shown in FIG. 4**.

A means 22 is provided to enable a pet to pass through the panel member 12 at will and without human intervention. Preferably, the pass through means 22 includes an opening 24 in the panel member 12 adjacent the lower end thereof and a pet movable closure member 26 which closes the opening 24 when not in use. The opening 24 may be any suitable size which enables a pet to pass therethrough. Preferably, the closure member 26 is constructed such that it provides protection from the weather when a pet is not passing therethrough. Examples of such pet pass through means 22 which are suitable for use with the present invention are disclosed in the Blackwell U.S. Pat. No. 3,654,733, Garrison U.S. Pat. No. 3,811,224 and Greene U.S. Pat. No. 3,464,158. Preferably, the closure member 26 and the opening 24 are provided with cooperating magnets or the like which tend to maintain the closure member 26 in the closed position even under substantial wind conditions. The closure member 26 may be constructed as an overlapping two piece closure member having magnets which releasably hold the two pieces together, whereby when a pet exits through the opening both closure pieces open, and when the pet enters through the opening the magnets separate and only one closure piece opens.

Preferably, a first sealing member 28, such as weather stripping or the like, is provided on the bottom of the panel member 12 and is operable to cooperate with the lower frame portion **6*b* for effecting a seal therebetween to provide protection from the weather when the panel member is in the first position. A second sealing member 30 may be provided for sealing any gap between the panel member 12 and the closure end 10 of the door 4 for also providing protection from the weather when the panel member 12 is in the first position. Preferably, the second sealing member 30 is an elongate bridging member which is connected to the panel member and extends beyond the outer edge thereof such that the bridging member 30 covers the gap on the outside of the door as shown in FIG. 2, thereby providing weather protection and making it difficult for an intruder to attempt to separate the panel member 12 from the door 4**.

In accordance with the present invention, a lock device 32 of any suitable type may be provided in the panel member 12 to cooperate with the existing sliding door lock (not shown) on the side frame portion **6*c* for selectively enabling the panel member 12 and, therefore, the sliding door 4 to be locked in place against the side frame portion 6*c* when the panel member 12** is in the first position.

While in accordance with the patent statute, the preferred forms and embodiments of the invention have been illustrated and described, it will be apparent to those of ordinary skill in the art that various changes and modifications may be made without deviating from the inventive concepts set forth above.

What is claimed is:

1. A pet portal device for use with a door slidably mounted in a frame and which is movable therein to define an opening between a closure end of the door and the adjacent frame portion, comprising a panel member constructed to fit in the opening between the closure end of said door and the adjacent frame portion to close the opening, means for allowing a pet to pass through said panel member, and means for movably connecting said panel member to said door, whereby said panel member is selectively movable between a first position wherein said panel member is in substantially coplanar relation with said door and closes said opening and a second position wherein said panel member is supported out of coplanar relation with said door such that the closure end of the door is able to close the opening by abutting the adjacent frame portion.

2. Device as defined in claim 1, wherein said connecting means includes a plurality of hinge members which pivotally connect said panel member to the door.

3. Device as defined in claim 2, wherein the adjacent frame portion includes a recess for receiving the closure end of the door, and said hinge members are connected to the door at a position which is set back a sufficient distance from the closure end of the door such that the closure end of the door can be received in the frame portion recess when said panel member is in said second position.

4. Device as defined in claim 2, wherein said hinge members are disposed on the inner portions of said panel member and said door such that said panel member may be pivotally moved inwardly to said second position wherein it is in substantially parallel relation to said door.

5. Device as defined in claim 1, wherein said means for enabling a pet to pass through said panel member includes an opening adjacent the lower end thereof provided with a pet movable closure member for closing said opening when not in use.

6. Device as defined in claim 1, wherein the upper portion of said panel member is made of a transparent material.

7. Device as defined in claim 1, and further comprising a first sealing member on the bottom of said panel member for providing a seal between said panel member and the adjacent frame portion when said panel member is in said first position.

8. Device as defined in claim 7, and further comprising a second sealing member on said panel member for providing a seal between said panel member and said door when said panel member is in said first position.

9. Device as defined in claim 8, wherein said second sealing member includes a bridging member connected to said panel member and extending beyond the side edge thereof adjacent to said door, said bridging member being constructed to cover the gap between the closure end of the door and said panel member when said panel member is in said first position.

* * * * *